US008870100B2

(12) United States Patent
Hsieh et al.

(10) Patent No.: US 8,870,100 B2
(45) Date of Patent: Oct. 28, 2014

(54) NOZZLE PLATE AND ATOMIZING MODULE USING THE SAME

(75) Inventors: Shu-Pin Hsieh, Taoyuan County (TW); Yu-Ju Su, Taoyuan County (TW); Chia-Chen Huang, Taoyuan County (TW); Chien-Hua Lin, Taoyuan County (TW); Yu-Chung Hsu, Taoyuan County (TW); Tai-Shuan Lin, Taoyuan County (TW); Mei-Hui Huang, Taoyuan County (TW); Chieh-Ming Hsiung, Taoyuan County (TW)

(73) Assignee: Microbase Technology Corporation, Taoyuan County (TW)

( * ) Notice: Subject to any disclaimer, the term of this patent is extended or adjusted under 35 U.S.C. 154(b) by 379 days.

(21) Appl. No.: 13/177,631

(22) Filed: Jul. 7, 2011

(65) Prior Publication Data

US 2012/0205468 A1 Aug. 16, 2012

(30) Foreign Application Priority Data

Feb. 15, 2011 (TW) ..... 100104897 A

(51) Int. Cl.
*B05B 1/14* (2006.01)

(52) U.S. Cl.
USPC ..... 239/553; 239/548; 239/553.5; 239/559; 239/567; 239/102.1

(58) Field of Classification Search
USPC ..... 239/102.1, 494, 553, 548, 553.5, 559, 239/567
See application file for complete search history.

(56) References Cited

U.S. PATENT DOCUMENTS 2,480,023 A * 8/1949 Holden ..... 401/28
5,383,597 A * 1/1995 Sooriakumar et al. ..... 239/5
7,299,997 B2 * 11/2007 Sayar ..... 239/5

FOREIGN PATENT DOCUMENTS

TW 331055 I 10/2010

* cited by examiner

*Primary Examiner* — Dinh Q Nguyen
(74) *Attorney, Agent, or Firm* — Leong C. Lei

(57) ABSTRACT

A nozzle plate and an atomizing module using the nozzle plate are disclosed. The atomizing module is installed at a cavity and includes a piezoelectric circular plate, a braking circular plate and a nozzle plate. The braking circular plate is installed on a side of the piezoelectric circular plate. The nozzle plate is a circular disc clamped between the piezoelectric circular plate and the braking circular plate, and the nozzle plate includes firing holes and first protrusions. Each first protrusion is non-circular and protruded in a direction towards the piezoelectric circular plate or the braking circular plate to form a multi-curved surface structure radially or circularly arranged into a specific geometric pattern. The nozzle plate can increase the atomizing area, atomizing quantity and liquid-gas exchange rate to prevent excessive stresses from concentrating at the center of the nozzle plate or vibrations from cracking or breaking the nozzle plate.

13 Claims, 16 Drawing Sheets

NOZZLE PLATE AND ATOMIZING MODULE USING THE SAME

CROSS-REFERENCE TO RELATED APPLICATIONS

This non-provisional application claims priority under 35 U.S.C. §119(a) on Patent Application No(s). 100104897 filed in Taiwan, R.O.C. on Feb. 15, 2011, the entire contents of which are hereby incorporated by reference.

BACKGROUND OF THE INVENTION

1. Field of the Invention

The present invention relates to an atomizer, in particular to a nozzle plate with a multi-curved surface structure having a geometric pattern radially or circularly arranged at the center of the nozzle plate, and an atomizing module using the nozzle plate.

2. Description of the Related Art

In general, an atomizer including an ultrasonic atomizer is made of a piezoelectric (PZT) ceramic material such as lead zirconate titanate. After a voltage is supplied, the ceramic material and a bundled metal back panel may be expanded, contracted or deformed, and energy is transmitted in form of waves, so that a vibration produced falls within a nanometer scale when the atomizer is operated at a frequency of ultrasonic waves, and the vibration can be controlled by the input voltage. The vibration produced by the piezoelectric material can be used for transmitting the ultrasonic waves to a nozzle plate, and a liquid near a nozzle can be divided into smaller molecules by the action of Rayleigh waves or surface waves to facilitate the spray and atomization of the liquid.

With reference to FIGS. 1 and 2 for an exploded view and a schematic view of a conventional atomizing device respectively, the conventional atomizing device 1 comprises an atomizing module 11 and a cavity 12. The atomizing module 11 includes a piezoelectric circular plate 113, a nozzle plate 112 and a braking circular plate 111. The nozzle plate 112 is substantially in a circular disc shape and includes a plurality of firing holes 1121 formed thereon, and the nozzle plate 112 is clamped between the piezoelectric circular plate 113 and the braking circular plate 111. The atomizing module 11 is installed on a side of the cavity 12. When the piezoelectric circular plate 113 is driven by a voltage to start vibrating, the vibration wave is transmitted to the nozzle plate 112, so that the liquid near the firing holes 1121 can be converted into water molecules.

However, the nozzle plate 112 is in a circular flat shape, so that it has the following drawbacks:

1. When the piezoelectric circular plate 113 vibrates, the produced vibration waves are transmitted in a direction from the external periphery of the nozzle plate 112 to the center of the nozzle plate 112, so that too much vibration energy is concentrated at the center of the nozzle plate 112, and the center area of the nozzle plate 112 has a too-large amplitude, and thus resulting in cracking or breaking the nozzle plate 112 easily by stress, and shortening the service life of the nozzle plate.

2. The vibration energy is concentrated at the center of the nozzle plate 112, so that an atomizing area is formed at the center of the nozzle plate 112 only. Since the atomizing area is situated at the center of the nozzle plate 112, an effective use of the firing holes 1121 of the nozzle plate 112 causes a poor atomization.

3. The atomization process requires a liquid-gas exchange to maintain a balance between internal and external pressures of an atomizing device. Due to the too-small atomizing area, the spray is unstable, and the flow of the sprayed liquid is unsteady.

4. The atomizing area is concentrated at the center area, and the molecular density of the atomized liquid is too large, so that liquid drops will collide easily to form liquid drops of a large diameter and lower the atomization efficiency.

With reference to FIGS. 3 to 6 for an exploded view of a conventional mist generator, a cross-sectional view of the conventional mist generator, a schematic view operating the conventional mist generator, and a schematic view of an atomizing area respectively, a mist generator as disclosed in R.O.C. Pat. No. I331055 is provided for overcoming the aforementioned drawbacks, wherein the mist generator 2 is used for atomizing a liquid and applied to an atomizing device having a through hole. The mist generator 2 comprises a braking circular plate 21, a nozzle plate 22, a piezoelectric circular plate 23 and a cavity 24. The nozzle plate 22 includes a plurality of firing holes 221 and is clamped between the braking circular plate 21 and the piezoelectric circular plate 23, and an atomizing area 223 is formed at the center of the nozzle plate 22. Wherein, a hemispherical curved surface structure 222 is formed at the center of the nozzle plate 22.

Although the design of the hemispherical surface structure can achieve the effects of improving the atomization of the prior art, reducing the stress concentrated at the center of the nozzle plate 22, and producing a larger atomizing area 223 theoretically, yet the practical application of mist generator 2 still has the following drawbacks:

1. When the nozzle plate 22 with the hemispherical surface structure is manufactured, the processing depth is inversely proportional to the curvature of the hemispherical surface due to the features of the manufacturing materials and properties. To achieve the effect of improving the atomization, the manufacturing depth at the center of the nozzle plate 22 must be equal to a certain depth. The smaller the curvature of the hemispherical surface, the easier is the manufacture for the required depth. To achieve the depth for the best atomization performance of the hemispherical surface, it is necessary to reduce the effective atomization range. In order to increase the effective atomization range, the radius of curvature for the manufacture must be increased. As a result, the manufacturing depth becomes shallow, and the atomization performance becomes lower. If it is necessary to achieve a smaller radius of curvature under the condition of the same size, a too-large stress will be exerted onto the nozzle plate 22 easily, and the structure will exceed the limit of deformation and end up with a crack or break, or the yield strength drops, so that the nozzle plate will be cracked or broken easily after the nozzle plate is vibrated for several times.

2. Due to the properties of the material of the nozzle plate 22, a greater diameter of the manufactured hemispherical surface will decrease the structural tension, weaken the inputted force and reduce the low-frequency resonance resisting capability, so that noises may be produced easily.

3. The packaged structure with this atomization method can clamp the nozzle plate 22 stably, and the internal diameter of the braking circular plate 21 is generally smaller than the internal diameter of the piezoelectric circular plate 23, and a vast majority of the vibration energies is transmitted to the nozzle plate 22, and the peripheral vibration area of the hemispherical surface design incapable of atomizing a liquid can be eliminated, and a portion of the firing holes 221 of the nozzle plate 22 has a lower utility rate, so that the atomizing area and the atomization on the nozzle plate 22 will be reduced. In addition, when the piezoelectric circular plate 21 is operated, adhesive is applied between layers of the piezoelectric circular plate 21, the nozzle plate 22 and the braking circular plate 23 and the force applying arms are of different lengths, the adhesion between components will be malfunctioned easily.

4. In the design of the hemispherical surface structure of the conventional nozzle plate, most of the transmitted energies of vibration waves are still concentrated at the center area, so that the micro holes formed at the center area have effective actions, but the vibration energy at the micro holes formed at the peripheral area is insufficient for an effective use, and the atomizing area cannot meet the design requirement.

SUMMARY OF THE INVENTION

Therefore, it is a primary objective of the present invention to provide a nozzle plate and an atomizing module using the nozzle plate, wherein the nozzle plate includes a plurality of protrusions formed thereon and a multi-curved surface structure radially or circularly arranged to achieve the effects of increasing an atomizing area, improving the stability of the atomization process, suppressing low-frequency vibrations and reducing the tensile stress for the manufacture.

To achieve the foregoing objective, the present invention provides a nozzle plate, comprising a plurality of firing holes and a plurality of first protrusions. Each of the first protrusions is in a non-circular shape, and the first protrusions are arranged into a geometric pattern with respect to the center of the nozzle plate.

Wherein, the nozzle plate includes three first protrusions, and each of the first protrusions is substantially in an elliptical shape and arranged equidistantly and radially outward towards the center of the nozzle plate.

Wherein, the nozzle plate includes four first protrusions, and each of the first protrusions is substantially in an elliptical shape, and arranged equidistantly and radially outward towards the center of the nozzle plate.

Wherein, the protrusions are deviated in a predetermined angle and arranged equidistantly and radially outward towards the center of the nozzle plate.

Wherein, the nozzle plate includes three first protrusions, and each of the first protrusions is substantially in a circular arc shape, and circularly arranged with respect to the center of the nozzle plate.

Wherein, the nozzle plate includes nine first protrusions, and every three adjacent first protrusions are arranged equidistantly and radially.

Wherein, the first protrusion is substantially in a rhombus shape, an elliptical shape, a triangular shape, a rectangular shape, an hourglass shape, a meniscus shape or a heart shape.

Wherein, the first protrusion has a cross-section which is a triangular cone, a single-arc plane, an oblique plane or a trapezium plane.

Wherein, the nozzle plate further includes a plurality of second protrusions, and the second protrusions are installed with an interval apart and corresponding to the interval between the first protrusions, and each second protrusion is protruded in the same protruding direction of each first protrusion.

Wherein, the second protrusions are substantially in a circular arc shape.

Wherein, the nozzle plate includes three second protrusions, and the second protrusions are circularly arranged with respect to the center of the nozzle plate.

Wherein, the second protrusion is substantially in a rhombus shape, an elliptical shape, a triangular shape, an hourglass shape, a meniscus shape or a heart shape.

Wherein, the second protrusion has a cross-section which is a triangular cone, a single-arc plane, an oblique plane or a trapezium plane.

Wherein, the ratio of the thickness of the nozzle plate to the height of the second protrusion falls within a range from 1:0.5 to 1:20.

Wherein, the internal diameter of the braking circular plate is equal to the internal diameter of the piezoelectric circular plate, and the external diameter of the braking circular plate is greater than the external diameter of the piezoelectric circular plate.

Wherein, the ratio of the thickness of the nozzle plate to the height of the first protrusion falls within a range from 1:0.5 to 1:20.

To achieve the foregoing objective, the present invention provides an atomizing module installed on a side of a cavity, and the atomizing module comprises a piezoelectric circular plate, a braking circular plate and a nozzle plate (such as the nozzle plate as described above), and the nozzle plate is installed between the piezoelectric circular plate and the braking circular plate.

Wherein, the external diameter of the braking circular plate greater than the external diameter of the piezoelectric circular plate.

Wherein, if the braking circular plate is installed proximate to a side of the cavity, each first protrusion is protruded in a direction towards the piezoelectric circular plate.

Wherein, if the piezoelectric circular plate is installed proximate to a side of the cavity, each first protrusion is protruded in a direction towards the braking circular plate.

DETAILED DESCRIPTION OF THE PREFERRED EMBODIMENTS

Figure 1:
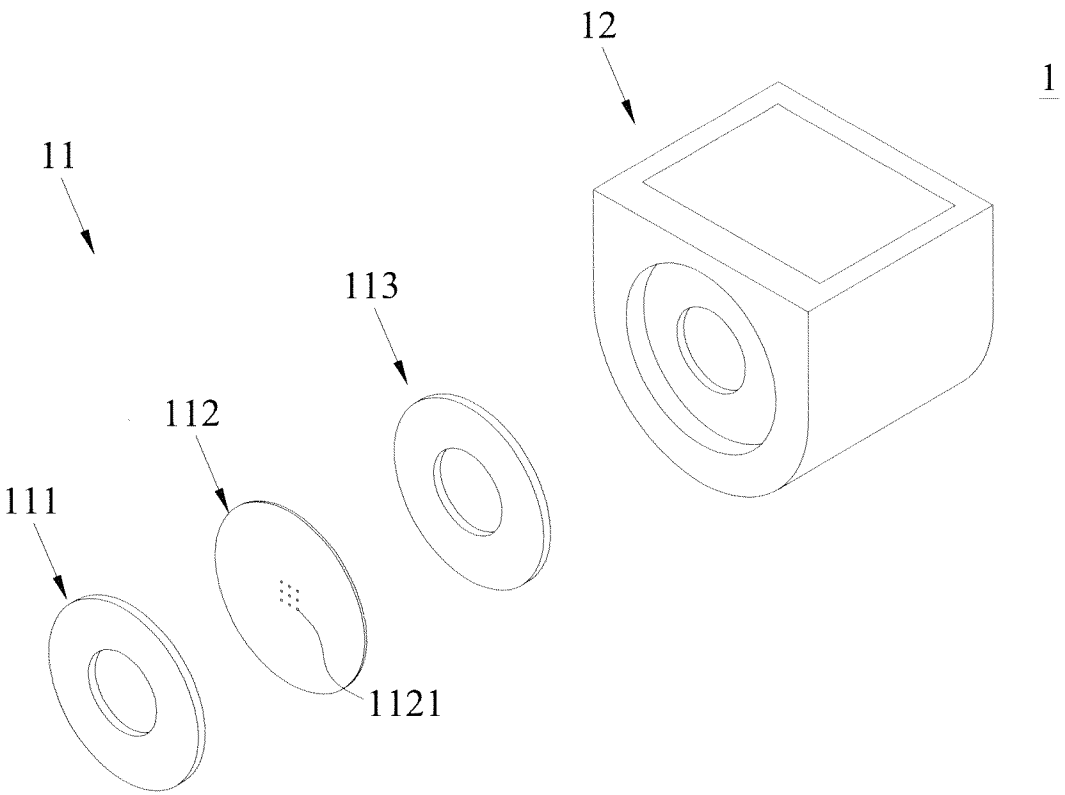
Fig. 1(PRIOR ART)
FIG. 1 is an exploded view of a conventional atomizing device.
Figure 2:
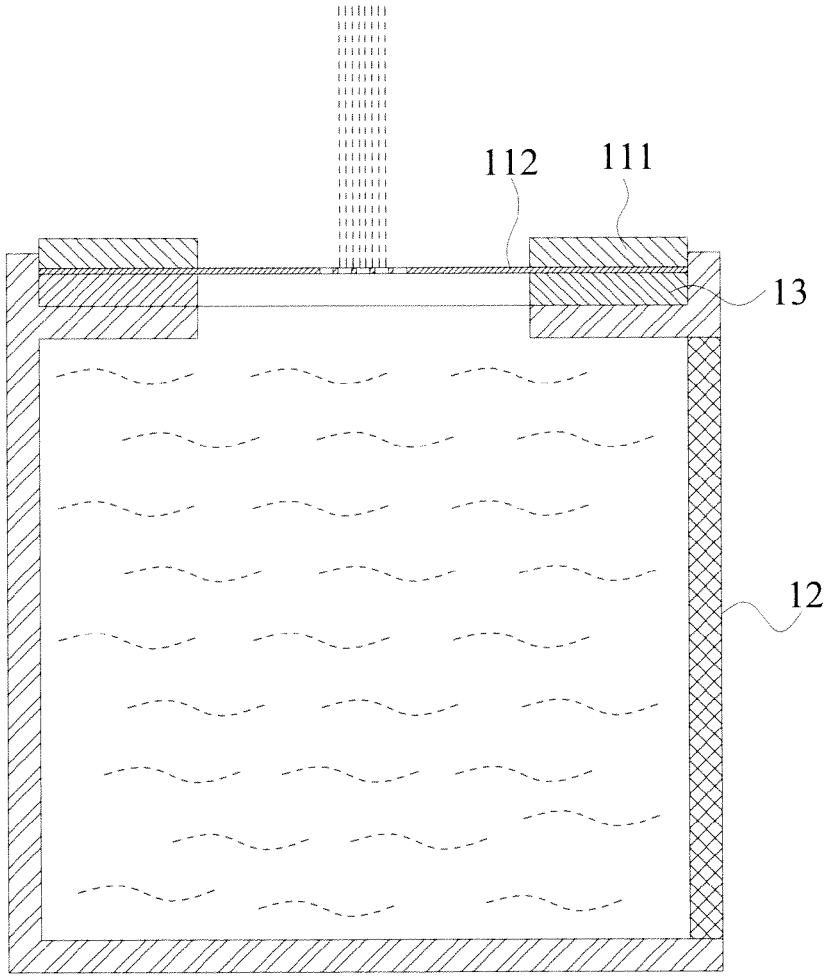
Fig. 2(PRIOR ART)
FIG. 2 is a schematic view of an operation of a conventional atomizing device of the present invention.
Figure 3:
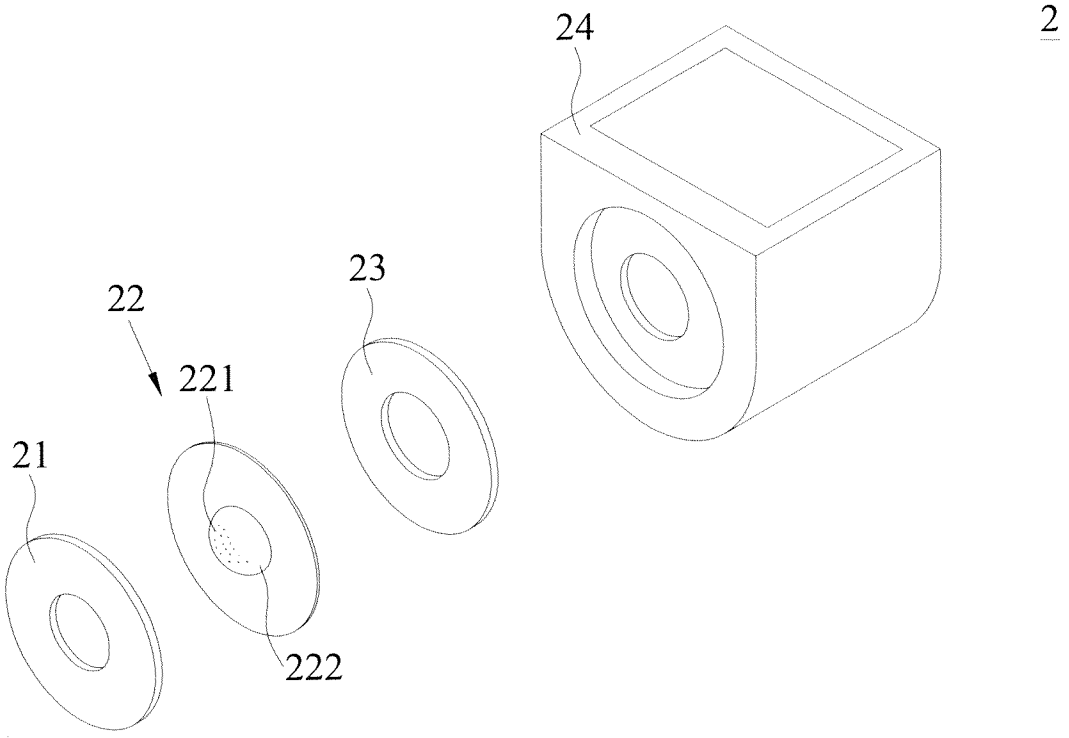
Fig. 3(PRIOR ART)
FIG. 3 is an exploded view of a conventional mist generator.
Figure 4:
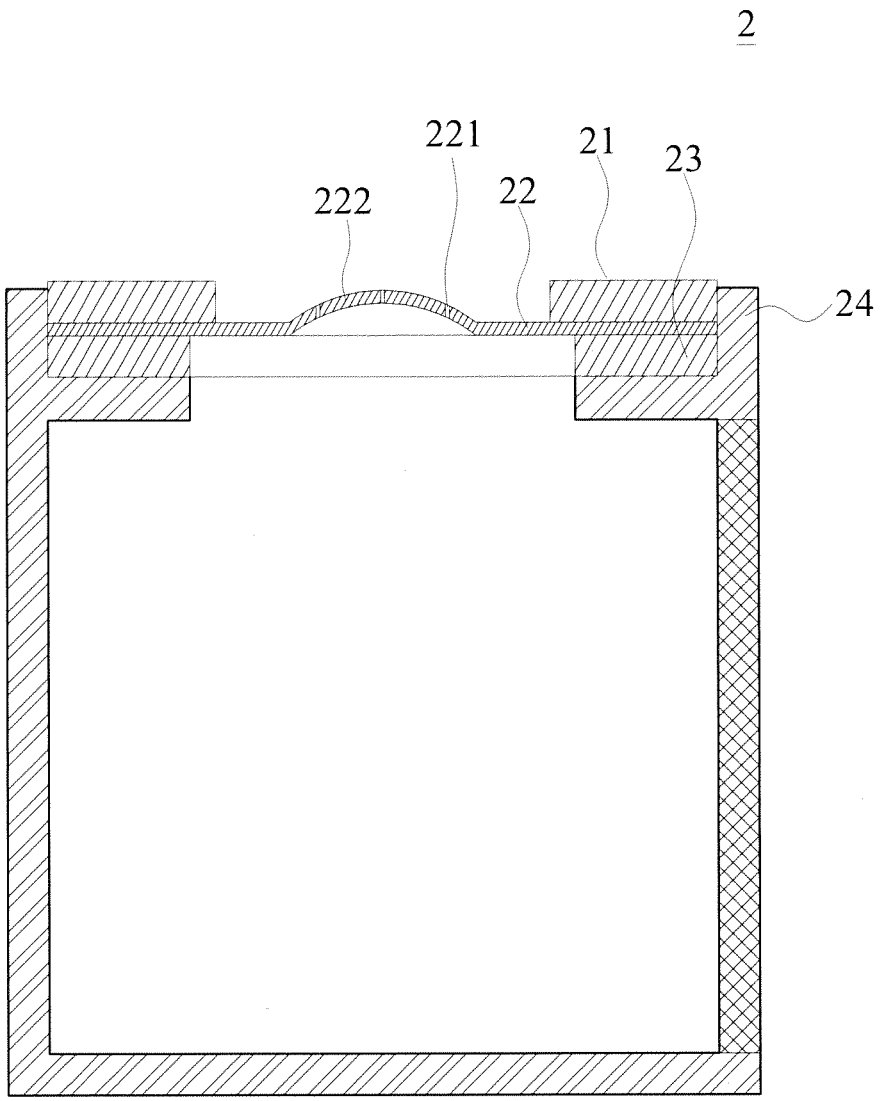
Fig. 4(PRIOR ART)
FIG. 4 is a cross-sectional view of the conventional mist generator.
Figure 5:
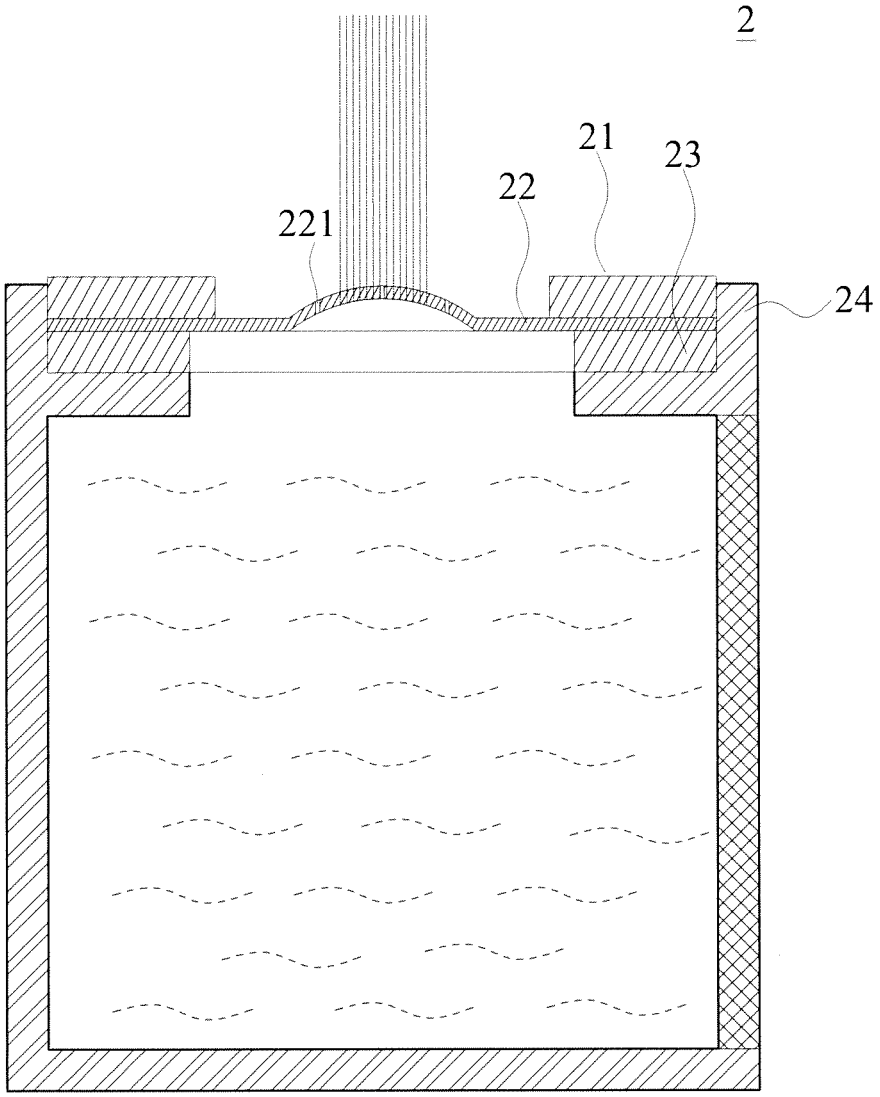
Fig. 5(PRIOR ART)
FIG. 5 is a schematic view of an operation of the conventional mist generator.
Figure 6:
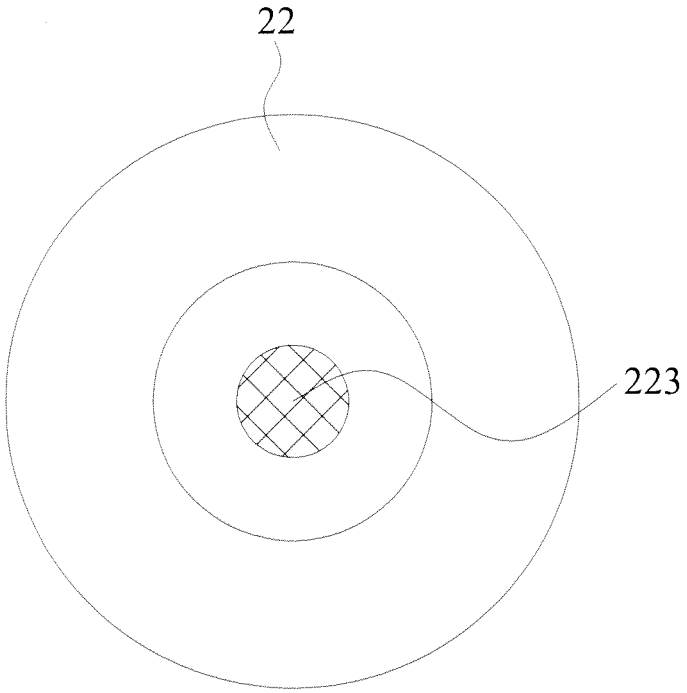
Fig. 6(PRIOR ART)
FIG. 6 is a schematic view of the conventional mist generator.
Figure 7A:
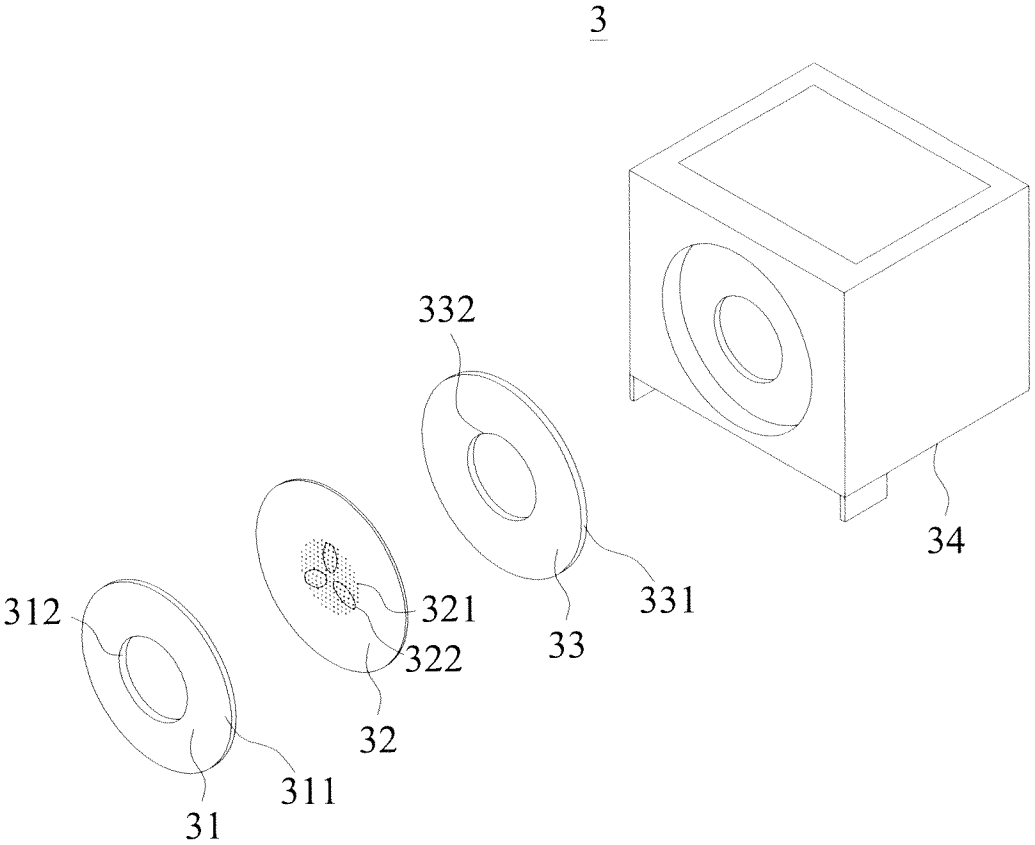
FIG. 7*a* is an exploded view of a nozzle plate and an atomizing module using the nozzle plate in accordance with a first preferred embodiment of the present invention.
Figure 7B:
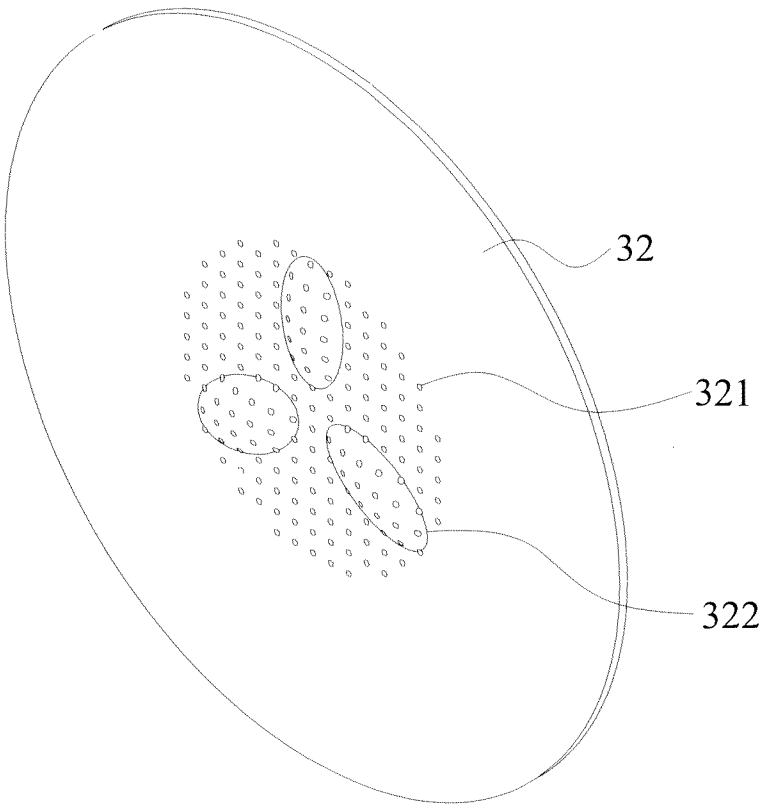
FIG. 7*b* is a perspective view of the nozzle plate and the atomizing module using the nozzle plate in accordance with the first preferred embodiment of the present invention.
Figure 8:
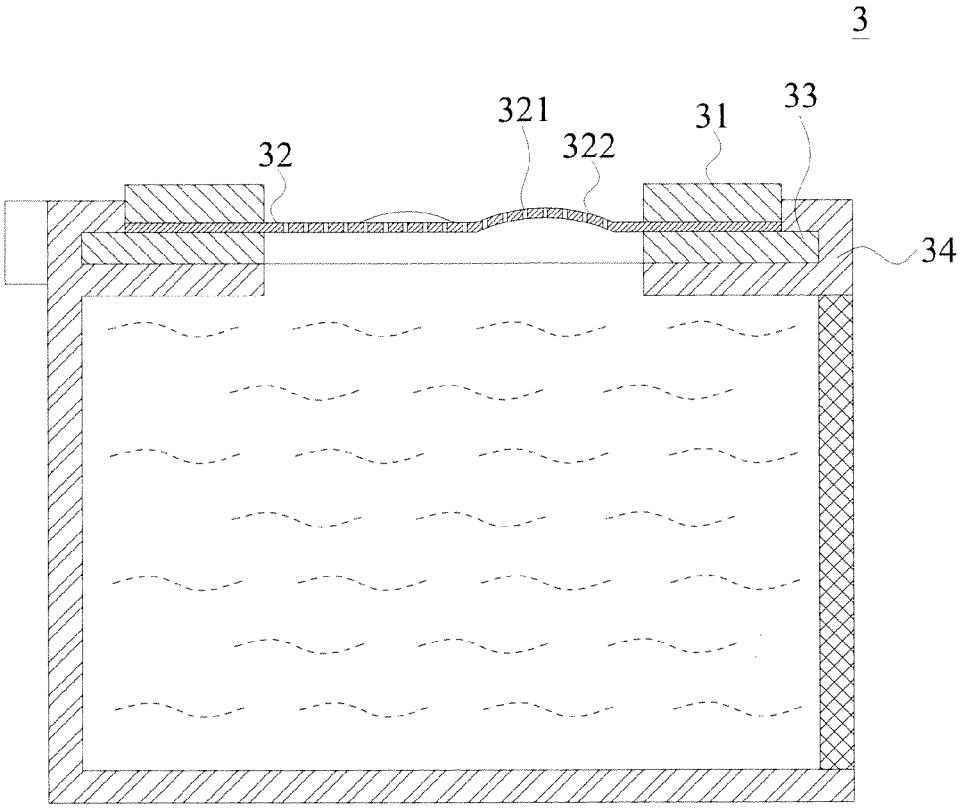
FIG. 8 is a cross-sectional view of the nozzle plate and the atomizing module using the nozzle plate in accordance with the first preferred embodiment of the present invention.
Figure 9:
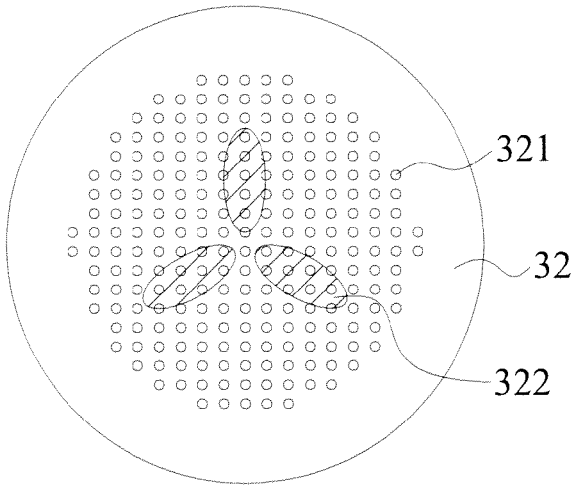
FIG. 9 is a schematic planar view of the nozzle plate and the atomizing module using the nozzle plate in accordance with the first preferred embodiment of the present invention.

The technical content of the present invention will become apparent by the detailed description of the following embodiments and the illustration of related drawings as follows.

With reference to FIGS. 7*a*, 7*b*, 8 and 9 for an exploded view, a perspective view, a cross-sectional view and a schematic planar view of a nozzle plate and an atomizing module using the nozzle plate in accordance with the first preferred embodiment of the present invention respectively, the atomizing module 3 is installed on a side of a cavity 34 and comprises a piezoelectric circular plate 31, a nozzle plate 32 and a braking circular plate 33.

The piezoelectric circular plate 31 is made of a piezoelectric ceramic material including lead zirconate titanate, and has an external diameter 311 and an internal diameter 312.

The braking circular plate 33 is a metal circular plate having an external diameter 331 and an internal diameter 332, and installed on a side of the piezoelectric circular plate 31. In this preferred embodiment, the internal diameter of the braking circular plate 33 is equal to the internal diameter 312 of the piezoelectric circular plate 31, and the external diameter 331 of the braking circular plate 33 is greater than the external diameter 311 of the piezoelectric circular plate 31.

The nozzle plate 32 is substantially in the shape of a disc with an external diameter falling within a range between the internal diameter and the external diameter of the piezoelectric circular plate 31 and the braking circular plate 33 for including the nozzle plate 32 between piezoelectric circular plate 31 and the braking circular plate 33. Wherein, the nozzle plate 32 includes a plurality of firing holes 321 formed thereon by excimer laser or any equivalent method, and each first protrusion 322 is a non-planar curve surface structure, and the first protrusion 322 is in a non-circular shape and arranged on the nozzle plate 32 to form a specific geometric pattern. In the first preferred embodiment, there are three first protrusions 322, and each of the protrusions 322 is in an elliptical shape, and an end of each protrusion 322 is installed towards the center of the nozzle plate 32 and arranged equidistantly and radially. In the cross-sectional view, the nozzle plate 32 and the first protrusions 322 formed on the nozzle plate 32 constitute a radial multi-curved surface structure. In addition, the ratio of the thickness of the nozzle plate 32 to the height of each first protrusion 322 falls within a range from 1:0.5 to 1:20. However, the invention is not limited to such ratio only, but it can be increased or decreased according to the manufacture or actual requirements.

When the atomizing module 3 is assembled, an adhesive (not shown in the figure) is applied to connect the piezoelectric circular plate 31, the nozzle plate 32 and the braking circular plate 33, and the piezoelectric circular plate 31 or the braking circular plate 33 of the atomizing module 3 is installed proximate to a side of the cavity 34. If the piezoelectric circular plate 31 is installed proximate to a side of the cavity 34, each first protrusion 322 is protruded in a direction towards the braking circular plate 33. If the braking circular plate 33 is installed proximate to a side of the cavity 34, each first protrusion 322 is protruded in a direction towards the piezoelectric circular plate 31 to maximize the atomization effect.

Figure 10:
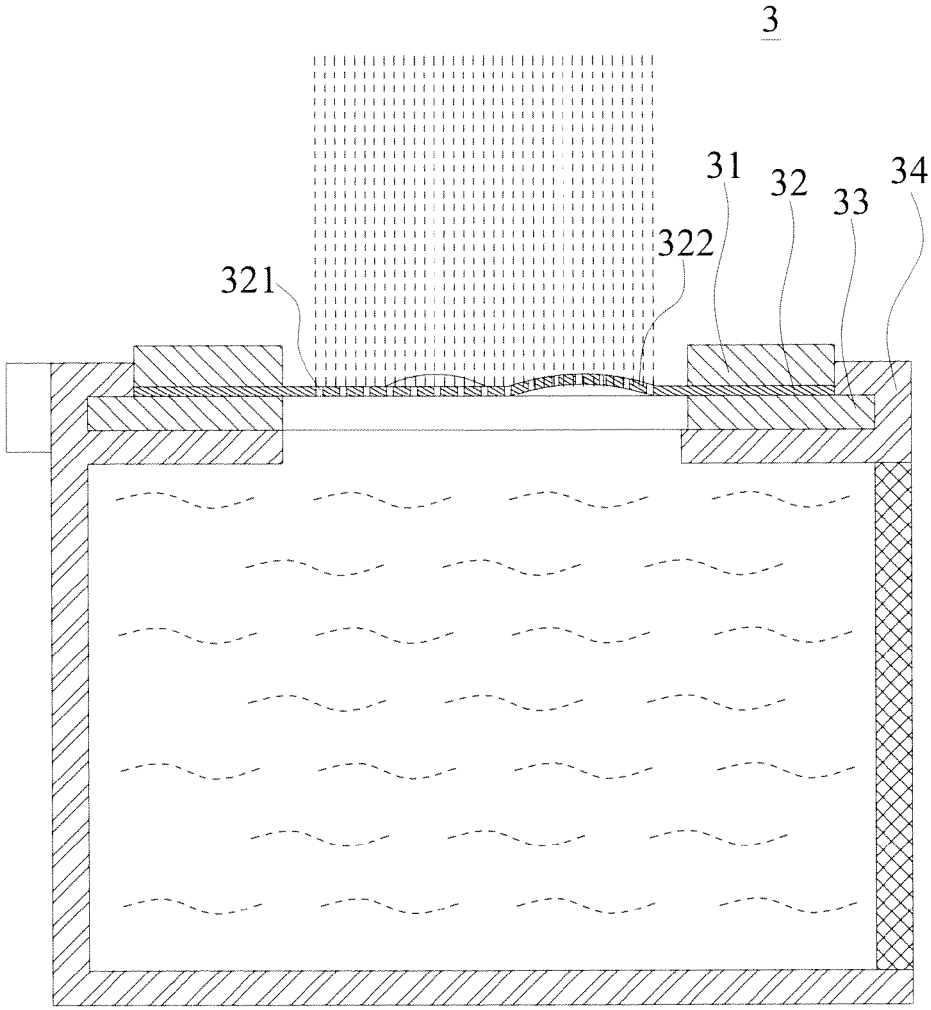
FIG. 10 is a schematic view of an operation of the nozzle plate and the atomizing module using the nozzle plate in accordance with the first preferred embodiment of the present invention.
Figure 11:
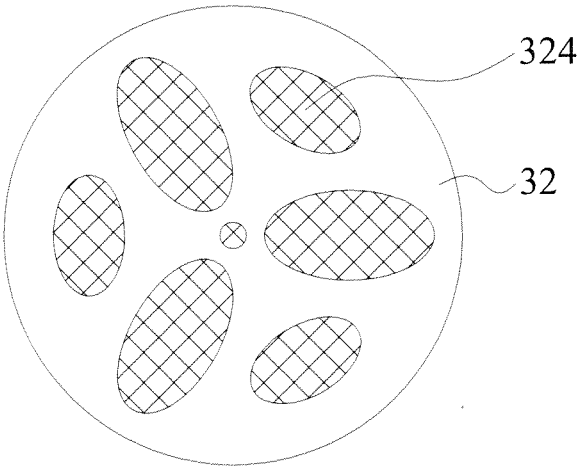
FIG. 11 is a schematic view of the nozzle plate and an atomizing area of the atomizing module in accordance with the first preferred embodiment of the present invention.

With reference to FIGS. 10 and 11 for a schematic view of an operation of an atomizing module and a schematic view of an atomizing area in accordance with a preferred embodiment of the present invention respectively, when the atomizing module 3 starts its operation, a voltage is inputted to the piezoelectric circular plate 31, so that the piezoelectric circular plate 31 is expanded, contracted or deformed repeatedly, and energies in form of vibration waves are transmitted to the nozzle plate 32 to vibrate the nozzle plate 32. Since the nozzle plate 32 includes the first protrusions 322, therefore the nozzle plate 32 can be vibrated to situate a liquid at a curved surface area formed b the first protrusions 322 and a plurality of firing holes 321 formed at a planar area adjacent to the first protrusions 322, and the liquid is converted into small molecules by the action of Rayleigh waves (which is also known as surface waves) to produce an atomization effect. Therefore, an atomizing area 324 including the curved area and planar area of the first protrusions 322 and its adjacent positions is formed, and this atomizing area 324 is much greater than the atomizing area of the prior art, and capable of improving the atomization by sufficiently using the firing holes 321 on the nozzle plate 32 and spraying nano-scale and uniform liquid drops.

Figure 12:
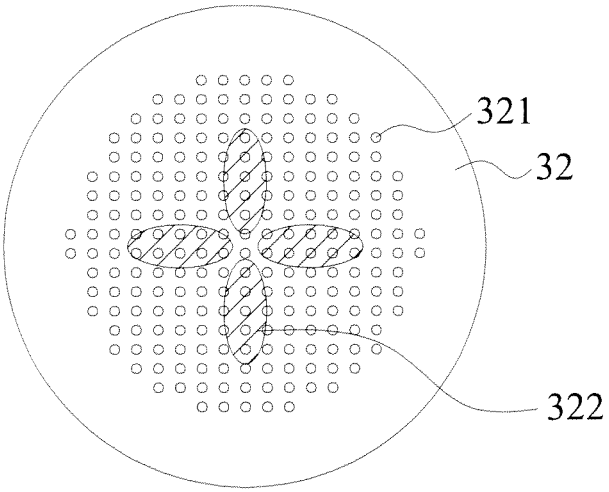
FIG. 12 is a schematic view of a nozzle plate and an atomizing module using the nozzle plate in accordance with a second preferred embodiment of the present invention.

Wherein, the arrangement of the protrusions of the nozzle plate 32 and other variations or modifications are not limited to the aforementioned embodiments only, but the invention can be implemented in accordance with the following embodiments:

In the second preferred embodiment, the nozzle plate 32 includes four first protrusions 322, and each of the first protrusions 322 is in an elliptical shape, and an end of each first protrusion 322 is aligned towards the center of the nozzle plate 32 and arranged equidistantly and radially outward, and the nozzle plate 32 includes the firing holes 321 formed on a surface of the nozzle plate 32 as shown in FIG. 12.

Figure 13:
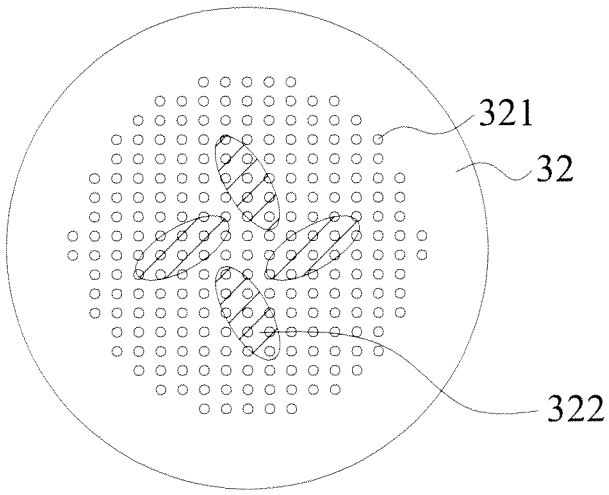
FIG. 13 is a schematic view of a nozzle plate and an atomizing module using the nozzle plate in accordance with a third preferred embodiment of the present invention.

In the third preferred embodiment, the first protrusion 322 includes four first protrusions 322, and each of the first protrusions 322 is in an elliptical shape and deviated in a predetermined angle, and an end of the first protrusion is aligned towards the center of the nozzle plate 32 and arranged equidistantly and radially outward, and the nozzle plate 32 includes the firing holes 321 formed on a surface of the nozzle plate 32 as shown in FIG. 13.

Figure 14:
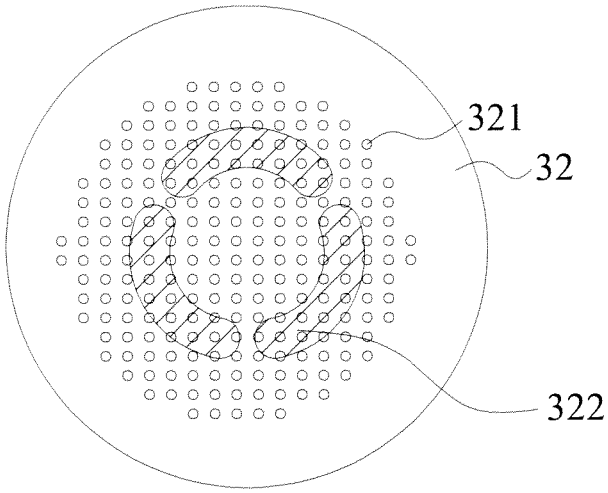
FIG. 14 is a schematic view of a nozzle plate and an atomizing module using the nozzle plate in accordance with a fourth preferred embodiment of the present invention.

In the fourth preferred embodiment, the nozzle plate 32 includes three first protrusions 322, and each of the first protrusions 322 is in a circular arc shape, and circularly arranged with respect to the center of the nozzle plate 32, and the nozzle plate 32 includes the firing holes 321 formed on a surface of the nozzle plate 32 as shown in FIG. 14.

Figure 15:
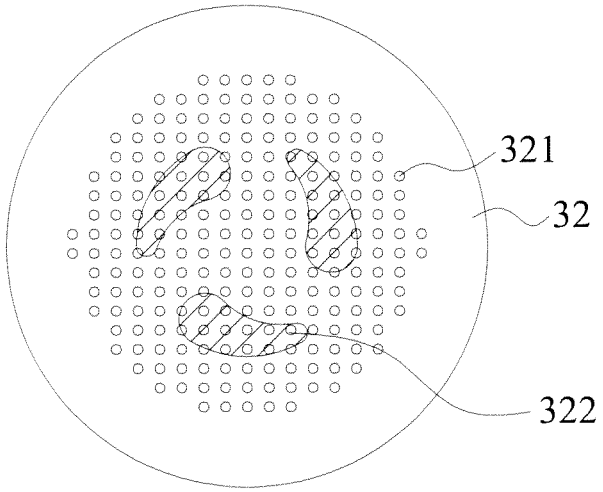
FIG. 15 is a schematic view of a nozzle plate and an atomizing module using the nozzle plate in accordance with a fifth preferred embodiment of the present invention.

In the fifth preferred embodiment, the nozzle plate 32 includes three first protrusions 322, and each of the first protrusion 322 is in a tapered arc shape, and circularly arranged with respect to the center of the nozzle plate 32, and the nozzle plate 32 includes the firing holes 321 formed on a surface of the nozzle plate 32 as shown in FIG. 15.

Figure 16:
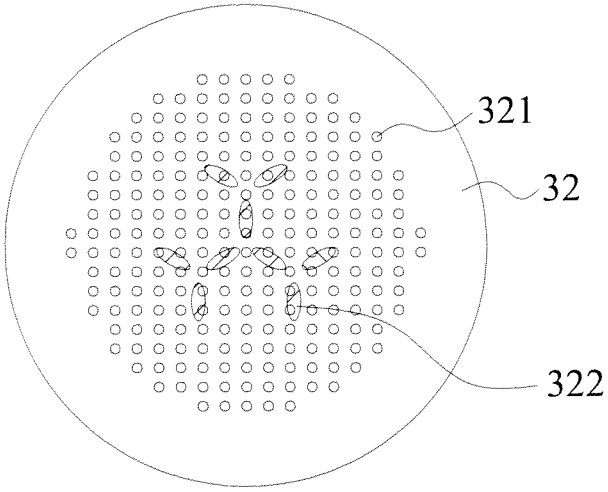
FIG. 16 is a schematic view of a nozzle plate and an atomizing module using the nozzle plate in accordance with a sixth preferred embodiment of the present invention.

In the sixth preferred embodiment, the nozzle plate 32 includes nine first protrusions 322, and every three adjacent first protrusions 322 are arranged equidistantly and radially to form a geometric pattern, and the nozzle plate 32 includes the firing holes 321 formed on a surface of the nozzle plate 32 as shown in FIG. 16.

Figure 17:
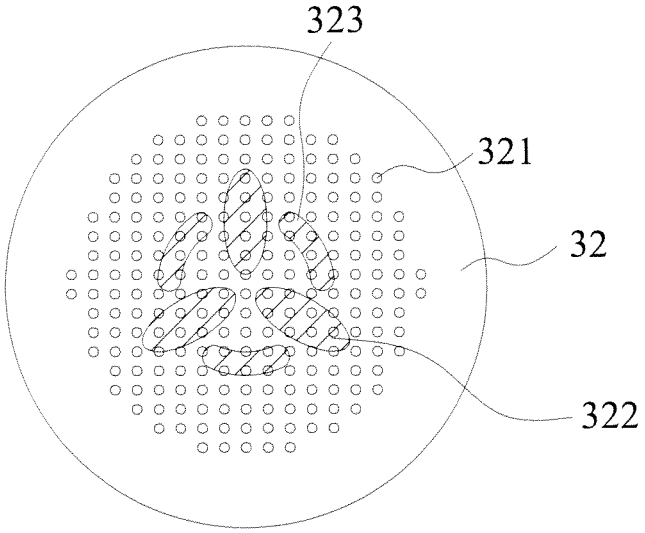
FIG. 17 is a schematic view of a nozzle plate and an atomizing module using the nozzle plate in accordance with a seventh preferred embodiment of the present invention.

In the seventh preferred embodiment, the nozzle plate 32, this embodiment not only includes the first protrusions 322 of the first preferred embodiment, but also includes three second protrusions 323, and each of the second protrusions 323 is protruded in the protruding direction of the first protrusion 322 and substantially in a circular arc shape, and installed with an interval apart between the corresponding first protrusions, and the nozzle plate 32 includes the firing holes 321 formed on a surface of the nozzle plate 32 as shown in FIG. 17. In addition, the ratio of the thickness of the nozzle plate 32 to the height of each second protrusion 323 falls within a range from 1:0.5 to 1:20, but the invention is not limited to such ratio only.

Figure 18:
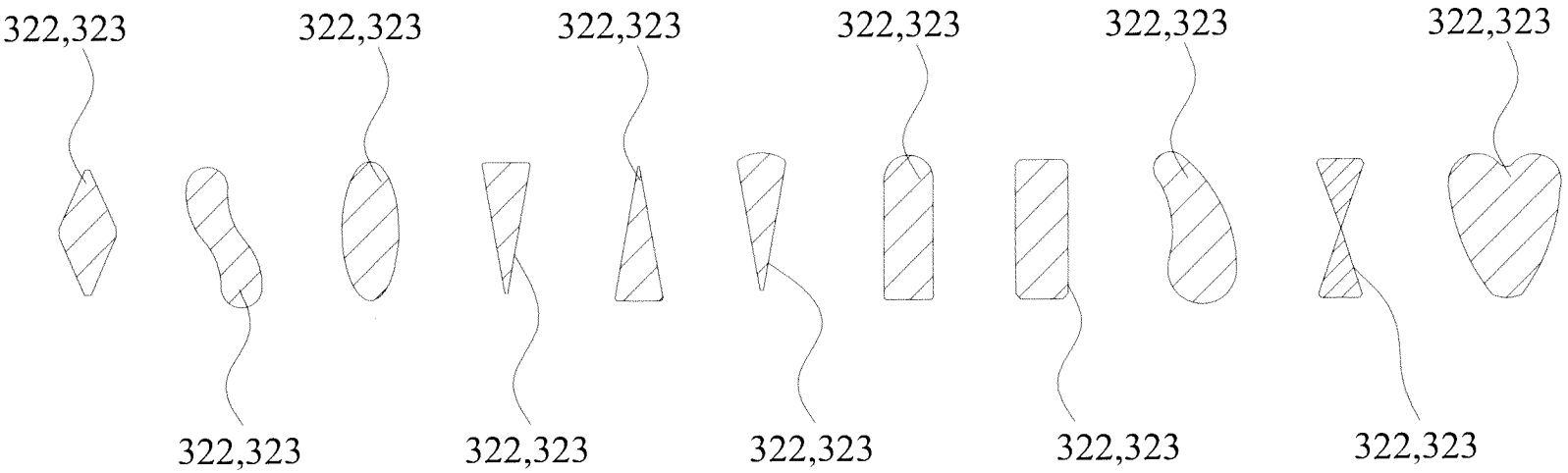
FIG. 18 shows schematic views of different appearance of the nozzle plate and the atomizing module using the nozzle plate of the present invention.

In each of the aforementioned preferred embodiments, the shapes of the first protrusion 322 and the second protrusions 323 are not limited to those as shown in the figures only, but they can also be in a rhombus shape, an elliptical shape, a triangular shape, an hourglass shape, a meniscus shape, a heart shape or any other shape as shown in FIG. 18. The quantity and the arrangement of the first protrusions 322 and second protrusions 323 are not limited to those given in the foregoing embodiments only, but they can be changed freely according to actual requirements.

Figure 19:
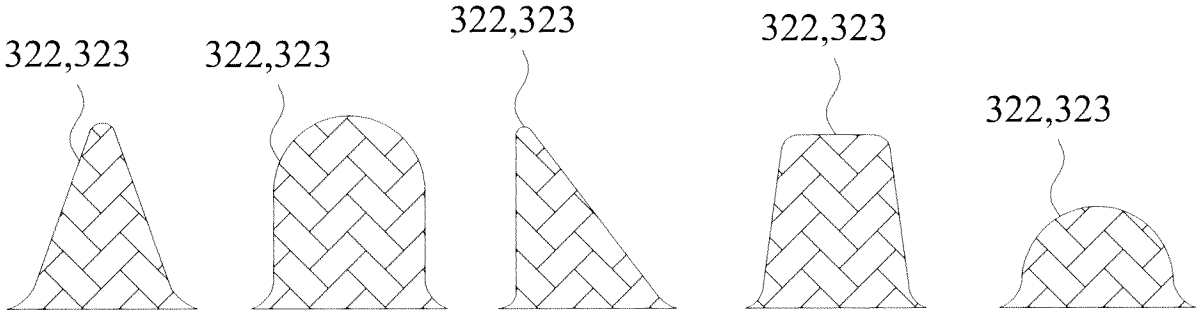
FIG. 19 shows cross-sectional views of different protrusions of the nozzle plate and the atomizing module using the nozzle plate of the present invention.

In each of the aforementioned preferred embodiments, the first protrusion 322 and the second protrusions 323 have a cross-section which is a triangular cone, a single-arc plane, an oblique plane, a trapezium plane, or any other form as shown in FIG. 19.

Since the atomizing module 3 has the nozzle plate 32 with a structure as described above, the atomizing module 3 has the following advantages:

1. The atomizing area is increased to improve the liquid-gas exchange rate at both internal and external sides of the nozzle plate 32 to enhance the stability of the atomization process and overcome the unsteady spray problem.

2. Compared with the conventional nozzle plate 22 with a single hemispherical surface structure, each first protrusion 322 and each second protrusion 323 of the invention can be manufactured with just half of the depth of the prior art to increase the atomizing area and adjust the curvature to an optimal value. The reduction of the manufacturing depth can prevent the nozzle plate from being cracked or broken easily by stresses in the manufacturing process.

3. The geometric pattern is formed by combing or arranging the first protrusions 322 or second protrusions 323, so that the radially or circularly arranged multi-curved surface structure formed by the nozzle plate 32 can disperse the liquid drops and change the traveling direction of the vibration waves, so as to destroy the regularity of the vibration waves being concentrated at the center of the nozzle plate 32, and overcome the too-large amplitude at the center area of the conventional nozzle plate and the problem of cracking or breaking the nozzle plate 32 easily by the centralized stress.

4. The radial multi-curved surface structure formed by the nozzle plate 32 can enhance the structural tension of each curved surface structure to strength the low-frequency resonance resisting capability.

5. The internal diameter 332 of the braking circular plate 33 is equal to the internal diameter 312 of the piezoelectric circular plate 31, so that an even cutting can be achieved in the packaging process to assure that the nozzle plate 32 is clamped securely in the middle to prevent a malfunction of the adhesive between different layers caused by the operation of the piezoelectric circular plate 31 or unequal lengths of the force applying arms.

6. The radial multi-curved surface structure formed by the nozzle plate 32 can transmit and disperse vibration energies uniformly, so that the nozzle plate with the multi-curved surface structure can have a resonance atomization area over other non-protruding positions, and more atomizing areas can be provided per unit area.

7. The multi-curved surface structure formed by arranging the protrusions of the nozzle plate and the corresponding piezoelectric circular plate can maintain the atomization effect, even if they are not operated at a constant operating frequency and a small deviated jump is occurred. Compared with the prior art that requires high-precision piezoelectric circular plate and driving circuit for an effective operation. The present invention can also lower the manufacturing cost.

While the invention has been described by means of specific embodiments, numerous modifications and variations could be made thereto by those skilled in the art without departing from the scope and spirit of the invention set forth in the claims.

In summation, the present invention improves over the prior art, and complies with the patent application requirements, and is duly filed for patent application.

What is claimed is:

1. A nozzle plate, substantially in the shape of a circular plate, comprising:

at least three first protrusions, each being substantially non-circular, installed on the nozzle plate and arranged with an interval apart with one another and respect to the center of the nozzle plate, and the first protrusions are arranged with respect to the center of the nozzle plate to form a geometric pattern; wherein the first protrusions are extruded by a predetermined angle, and an end of each protrusion is arranged towards the center of the nozzle plate, and the protrusions are radially and equidistantly installed with respect to the center of the nozzle plate; and a plurality of firing holes, formed on the nozzle plate and the first protrusions.

2. The nozzle plate of claim 1, further comprising a plurality of second protrusions installed with an interval apart from one another, and corresponding to intervals of the first protrusions respectively, and each second protrusion is protruded in the same protruding direction of each first protrusion.

3. The nozzle plate of claim 2, wherein each of the second protrusions is substantially in a circular arc shape.

4. The nozzle plate of claim 2, wherein the second protrusions are circularly arranged with respect to the center of the nozzle plate when the second protrusions come with three quantities.

5. The nozzle plate of claim 2, wherein each of the second protrusions is substantially in a rhombus shape, an elliptical shape, a triangular shape, an hourglass shape, a meniscus shape or a heart shape.

6. The nozzle plate of claim 5, wherein the second protrusion has a cross-section which is a triangular cone, a single-arc plane, an oblique plane or a trapezium plane.

7. The nozzle plate of claim 2, wherein the ratio of the thickness of the nozzle plate to the height of the second protrusion falls within a range from 1:0.5 to 1:20.

8. The nozzle plate of claim 1, wherein the first protrusions are deviated by a predetermined angle, and an end of each protrusion is arranged towards the center of the nozzle plate, and the protrusions are radially and equidistantly installed with respect to the center of the nozzle plate.

9. The nozzle plate of claim 1, wherein, each of the first protrusion being substantially in a circular arc shape, and circularly arranged with respect to the center of the nozzle plate when the first protrusions come with three quantities.

10. The nozzle plate of claim 1, wherein, every three adjacent first protrusion being arranged equidistantly and radially when the first protrusions come with nine quantities.

11. The nozzle plate of claim 1, wherein each of the first protrusions is substantially in a rhombus shape, an elliptical shape, a triangular shape, a rectangular shape, an hourglass shape, a meniscus shape or a heart shape.

12. The nozzle plate of claim 1, wherein each of the first protrusions has a cross-section which is a triangular cone, a single-arc plane, an oblique plane or a trapezium plane.

13. The nozzle plate of claim 1, wherein the ratio of the thickness of the nozzle plate to the height of the first protrusion falls within a range from 1:0.5 to 1:20.

* * * * *